US005421407A

United States Patent [19]

Thornburrow

[11] Patent Number: 5,421,407

[45] Date of Patent: Jun. 6, 1995

[54] WELLHEAD LOAD SUPPORT RING

[75] Inventor: Edward T. Thornburrow, Leeds, United Kingdom

[73] Assignee: Cooper Industries, Inc., Houston, Tex.

[21] Appl. No.: 117,817

[22] Filed: Sep. 8, 1993

[30] Foreign Application Priority Data

Oct. 16, 1992 [EP] European Pat. Off. ..... 92309475

[51] Int. Cl.[6] ..... E21B 33/04

[52] U.S. Cl. ..... 166/88; 166/208; 385/24; 385/39

[58] Field of Search ..... 166/88, 382, 348, 341; 285/24, 39, 86

[56] References Cited

U.S. PATENT DOCUMENTS 3,287,035 11/1966 Greenwood ..... 166/88
4,541,490 9/1985 Bigbie et al. ..... 166/88 X
4,653,589 3/1987 Alandy ..... 166/382
4,934,459 6/1990 Baugh et al. ..... 166/382 X
5,020,593 6/1991 Milberger ..... 166/382 X
5,031,696 7/1991 Zwiegel ..... 166/88 X
5,092,400 3/1992 Jagert ..... 166/88
5,240,076 8/1993 Cromar et al. ..... 166/382

*Primary Examiner*—Ramon S. Britts
*Assistant Examiner*—Frank S. Tsay
*Attorney, Agent, or Firm*—Conley, Rose & Tayon

[57] ABSTRACT

A tubing hanger (2) is suspended in a spool (1) by a composite load support ring (7,8). Upon running-in, the hanger expands the ring into engagement with complementary grooves (34) in the spool wall. By making the load support ring from individual split rings (7,8), a radially large bearing area is provided for supporting the hanger and/or a seal, whilst enabling an appreciable expansion of the ring without it yielding beyond its elastic limit.

12 Claims, 3 Drawing Sheets

WELLHEAD LOAD SUPPORT RING

BACKGROUND OF THE INVENTION

1. Field of the Invention

In the oil and gas industry there is frequently a need to fix within a spool or other tubular wellhead member a support ring which is capable of taking large axial loads. For example, such a ring may form part of a hanger suspension system for a tubing or casing string, and/or provide an axial bearing surface for a load set high pressure seal.

2. Description of the Related Art

One construction of ring which has been considered for this purpose is a split metallic ring, that is to say an almost continuous ring which is discontinuous and has a narrow gap at one angular position. The ring may be expanded and held expanded by a tool, such as one having a frusto-conical surface which moves axially through the ring. The ring has an external profile, such as a "knuckle" profile consisting of a series of axially spaced annular ribs, which, as the ring is expanded, enter complementary annular grooves in the surrounding wall of the tubular member. This provides a very secure fixing of the ring axially within the tubular member without making significant inroads into the wall thickness of the tubular member, or of providing within the tubular member a permanent landing bowl which would reduce the minimum diameter of the tubular member and hence limit the maximum size of casing strings or other components which could be introduced down through the tubular member before fitting of the load ring.

However, a disadvantage with the use of such expansible metal split load support ring is that, if it is to have sufficient radial thickness to provide the large bearing area which is often required, the ring cannot be expanded sufficiently to ensure secure locking with the surrounding tubular member, without the metal from which the ring is made yielding beyond its elastic limit and taking a permanent deformation. This is disadvantageous as it makes it difficult to recover the ring since it will not contract elastically when the expanding force is removed, and will remain in engagement with the tubular member. The problem is exacerbated in that such a metallic support ring will normally be made of suitable alloy to avoid corrosion by, for example, hydrogen sulphide emanating from the well, and such alloys have restrictive yield strengths.

It has previously been sought to overcome this problem by providing in the load support ring a series of angularly spaced radial cuts extending part-way through the radial thickness of the ring. However this significantly reduces the overall strength of the ring.

SUMMARY OF THE INVENTION

In accordance with the present invention, a composite load support ring for use in a wellhead comprises a radially innermost first metallic split ring and a radially outermost second metallic split ring which are interconnected so that axial and radial forces can be transmitted from the first ring to the second ring, the radially outer surface of the second ring being formed with a plurality of axially spaced annular ribs for engagement, upon radial expansion of the composite ring, with complementary annular grooves in a surrounding tubular wellhead member to fix the composite ring in the wellhead member, and the radially inner surface of the first ring being formed with a frusto-conical taper such that relative axial movement of a complementary frusto-conical surface in engagement with the taper will expand the composite ring radially outwards.

This elegant solution of dividing the load support ring into at least two split rings each providing only a part of the overall radial width of the load support ring, achieves very simply the necessary radial width to provide the required support for axial loads, whilst enabling sufficient expansion of the rings without exceeding the elastic limit. Removal of the expanding force therefore enables the rings to retract again so that the outermost ring moves substantially fully out of engagement with the grooves in the tubular wellhead member, allowing axial recovery of the load support ring.

The first and second rings require to be fastened together securely and a screw threaded connection is appropriate. The connection may be a direct one by interengaging screw threads on the radially outer surface of the first ring and the radially inner surface of the second ring. However it is not excluded that one or more intermediate rings might be interposed, by a screw threaded coupling, between the innermost first ring and outermost second ring. Since both axial and radial loads have to be transferred between the first and second rings, the screw thread used for the interconnection preferably has a profile with an axially broad substantially flat crest.

When the first and second rings are interconnected by interengaging screw threads, in order to prevent inadvertent rotation, and hence screwing, of one ring relatively to the other, the two rings are preferably keyed together, for example by means of a key positioned substantially diametrically opposite to a position at which the first and second rings are split.

The annular ribs provided on the radially outer surface of the second ring preferably have flanks extending at between 40° and 50° to the axis of the rings. This ensures that if there is any slight misalignment when the load support ring is expanded, the flanks of the ribs will ride on the flanks of the complementary grooves in the wellhead member, and effectively provide a fairlead bringing the ribs and grooves into the correct alignment. Also, in the event of the load support ring not contracting completely out of engagement with the grooves, when the expanding force is relieved, upon recovery of the load support ring, the inclined flanks of the ribs will enable the ribs to ride out of the grooves, and forcibly contract the load support ring, thereby avoiding serious obstruction between the load support ring and wellhead member.

A primary use of the load support ring is in a suspension assembly for a tubing or casing string, in which case the suspension assembly comprises a hanger surrounded by the composite load ring, the hanger being formed with the complementary frusto-conical surface for expanding the load support ring, and with a shoulder to land on the load support ring when the load support ring has been fully expanded.

In such a suspension assembly, when the tubing or casing string is run into the wellhead, with the load support ring surrounding the tubing or casing hanger, some reaction must be provided on the load support ring to enable relative movement between the hanger and load support ring to expand the ring. For this purpose, the unexpanded load support ring may seat on a blocking ring. This is prevented from moving axially on the hanger by shear elements which, when the assembly is lowered into the wellhead member and the blocking ring meets an obstruction, shear to allow the hanger to move down relatively to the blocking ring and load support ring and expand the load support ring.

Clearances within the wellhead are extremely fine and, in order to prevent the unexpanded load support ring from abrading the wellhead member during running-in of the tubing or casing string, the load support ring is preferably initially fixed against horizontal displacement on the blocking ring by means of shear elements which are arranged to shear when the load support ring is expanded.

The new load support ring is likely to be used in an environment in which it is exposed to extremely high pressures of the order of 15 to 20,000 psi ($10.3\times10^7$ to $13.8\times10^7$ Pa) or even more, A high pressure seal must therefore be set between the hanger and wellhead member and the large radial dimension of the load support ring is available, not only to land the tubing or casing hanger, but also to provide the axial reaction for setting the seal. Thus the hanger may carry a surrounding seal assembly for sealing the hanger to the wellhead member, the sealing assembly being set by compression between a shoulder on the hanger and the load support ring during the final downward movement of the hanger relatively to the load support ring.

It is usually necessary not only to suspend the tubing or casing hanger in the wellhead, but also to lock it down to prevent upward displacement under the hydraulic forces in the well. For this reason the hanger may carry a surrounding metallic split lockdown ring formed on its radially outer surface with at least one and preferably with a plurality of axially spaced annular ribs for engagement, upon radial expansion of the lockdown ring, with complementary annular grooves in the wellhead member and, on its radially inner surface with a downwardly and radially inwardly frusto-conical taper, and a lockdown sleeve which is screwed relatively to the hanger body and has a radially outer frusto-conical surface complementary with that of the lockdown ring whereby the lockdown ring may be expanded upon screwing of the sleeve along the hanger.

Screw threads are prone to seizure over a period of time, particularly when exposed to corrosive well fluids. If the lockdown sleeve cannot be unscrewed relatively to the hanger, to allow retraction of the lockdown ring, retrieval of the tubing or casing string will involve a severe problem. To overcome this, the lockdown sleeve may be screwed onto an annular carrier which is locked axially on the hanger by pins and J-slots, and against rotation relatively to the hanger by shear elements which, in the event of seizure of screw threads between the lockdown sleeve and the carrier, are arranged to shear to allow rotary and axial movement of the carrier to disengage the pins from their J-slots and hence axial movement of the lockdown sleeve and retraction of the lockdown ring.

BRIEF DESCRIPTION OF THE DRAWINGS

Part of a wellhead incorporating a load support ring according to the present invention is illustrated in the accompanying drawings, in which.

DESCRIPTION OF THE PREFERRED EMBODIMENTS

The part of the wellhead shown has wellhead housing in the form of a tubular spool 1 in which is suspended a hanger 2 of a tubing string 3. The tubing string extends down through a conventional coaxial array of casing strings.

Figure 1:
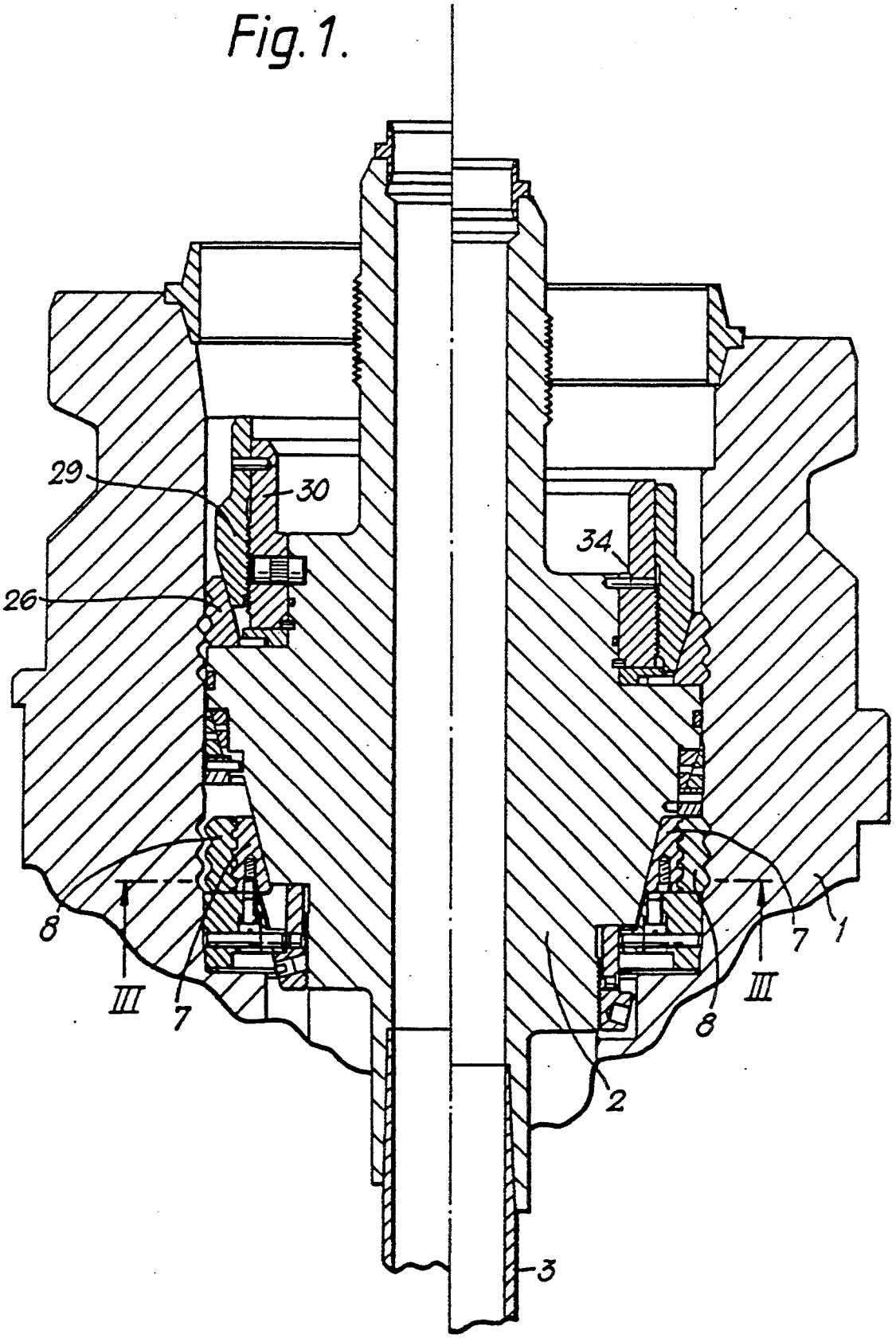
FIG. 1 is a vertical axial section showing, on the left hand side of the centre line the movable parts unset, and on the right hand side of the centre line, the parts set.
Figure 2:
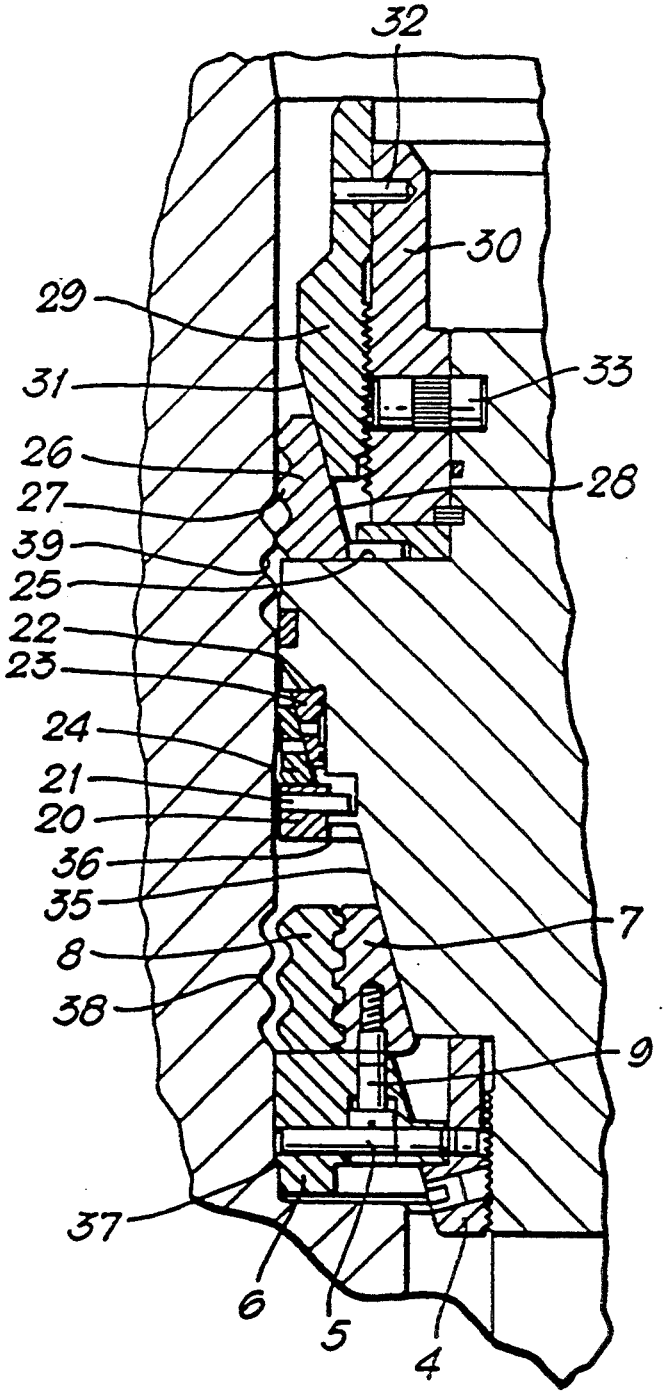
FIG. 2 is an enlargement of part of FIG. 1.

With reference to the left hand side of FIG. 1 and FIG. 2, the parts carried by the tubing hanger 2 will first be described in the position which they adopt during running-in. Thus screwed onto the body of the tubing hanger 2 is a sleeve 4 to which there is fixed by an angularly spaced array of shear pins 5 a blocking ring 6. Seated on the blocking ring is a composite load support ring consisting of unexpanded inner and outer split alloy rings 7 and 8, each with a protective plastic coating. These rings are held coaxial with the hanger body 2 by means of an angularly spaced array of shear pins 9 engaging between the blocking ring 6 and inner split ring 7.

Figure 3:
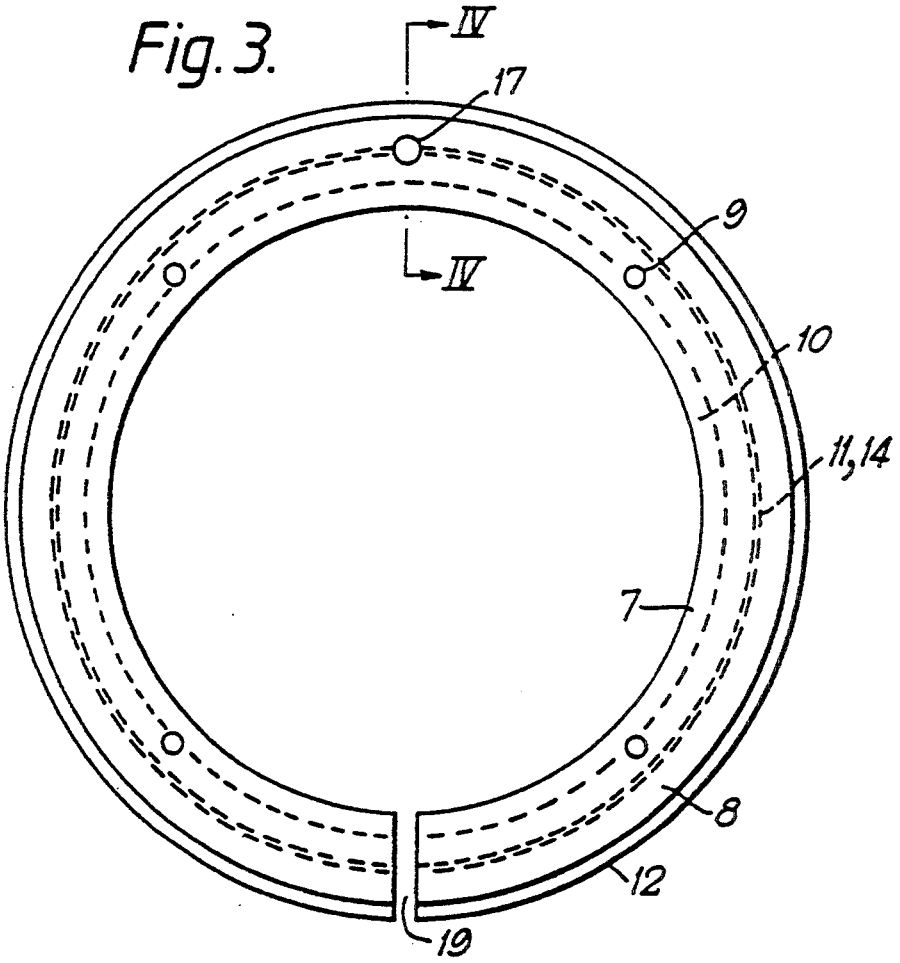
FIG. 3 is a section taken on the line III—III in FIG. 1.
Figure 4:
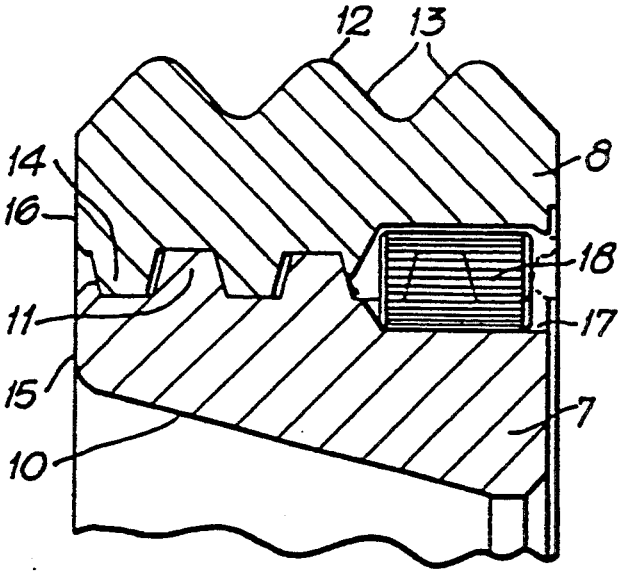
FIG. 4 is a section taken on the line IV—IV in FIG. 3.

The construction of the load support ring can be seen better in FIGS. 3 and 4. The inner ring 7 has a radially inner frusto-conical surface 10 and, on its radially outer surface, a screw thread 11. The outer ring 8 has, on its radially outer surface, three axially spaced annular ribs 12 having flanks 13 inclined at substantially 45° to the axis of the rings. On its radially inner surface, the ring 8 is formed with a screw thread 14 which engages with the screw thread 11. These screw threads have a modified Acme profile and have minimal clearance in the radial direction but the conventional clearance in the axial direction. The load supporting is assembled by screwing the rings 7 and 8 into one another until their upper faces 15 and 16 are flush with one another. A bore 17 is then drilled through the bottoms of the rings, intersecting both rings, and a key 18 is fitted loosely into the bore and held in position by peening over the entrance to the bore. This key effectively prevents screwing of one ring relatively to the other. A minimal thickness saw cut 19 is then made through the two rings at a position diametrically opposite to the key 18 to form the rings into split rings.

At a position spaced above the load support ring 7,8, a reaction ring 20 is axially fixed on the hanger body 2 by an angularly spaced array of shear pins 21. Located loosely and unset between the reaction ring 20 and a shoulder 22 on the hanger body are two wedge seal rings 23,24.

Higher up the hanger, and supported on a landing 25 of the hanger body is an expandable metallic split lockdown ring 26, formed on its radially outer surface with a series of annular ribs 27 and, on its inner surface, with a downwardly tapering frusto-conical profile 28. Above this ring 26 is a lockdown sleeve 29 which is screwed onto an annular carrier 30 and has on its radially outer surface a downwardly tapering frusto-conical profile 31 complementary with the profile 28. During running in, a single shear pin 32 prevents unwanted rotation between the sleeve 29 and carrier 30. The carrier 30 is locked axially on the hanger 2 by an angularly spaced array of pins 33 which are fixed in bores in the carrier and project radially inwardly into respective J-slots in the hanger 2. Relative rotation of the carrier 30 and hanger 2, which would disengage the carrier from the hanger, and allow its upward-removal from the hanger, is prevented by an angularly spaced array of shear pins 34 (shown only on the right hand side in FIG. 1).

The hanger 2 has a downwardly tapering frusto-conical profile 35 adjacent and complementary to the frusto-conical surface 10 of the ring 7; and a landing shoulder 36 above the load support ring 7,8.

When, during completion of the well, the hanger 2 makes a landing in the spool 1, the initial engagement is between the lower edge of the blocking ring 6 and a seating 37 in the spool. The radial width of this seating 37 is very small and, although it is sufficient for its purposes, it would be quite insufficient to provide for suspension for the tubing string. The obstruction which it provides to passage through the spool, prior to running-in of the tubing string, is therefore minimal.

As the blocking ring 6 lands on and is resisted against further downward axial movement by the seating 37, the hanger 2 and other parts continue to move downwardly, causing the pins 5 to shear. Consequently the engagement between the frusto-conical surfaces 35 and 10 begins to expand the rings 7,8 radially outwardly, initially causing the shearing of the pins 9. As this movement continues, the annular ribs 12 on the ring 8 enter complementary grooves 38 in the wall of the spool. Before the ribs have fully entered the grooves, the reaction ring 20 seats on the ring 8, and continuing downward movement of the hanger 2 causes the pins 21 to shear. The wedge sealing elements 23 and 24 are thus compressed between the reaction ring 20 and the shoulder 22 and are caused to slide over one another so that they seal firmly both against one another and the hanger and spool to provide a secure high pressure metal to metal seal.

Final downward movement of the hanger may be incomplete until pressure is applied down onto the hanger by means of an existing proven design of hydraulically operated tool, engaged with the top faces of the carrier 30 and sleeve 29. Under the influence of this tool, the hanger advances until the shoulder 36 lands on the ring 7, whereupon the tubing string is securely suspended whilst sustaining this downward pressure the tool rotates the sleeve 29 so that the pin 32 shears and the sleeve screws downwardly on the carrier 30 and expands the ring 26 so that the ribs 27 enter complementary grooves 39 in the wall of the spool to provide a secure lockdown for the tubing string. The parts are now all set as shown on the right hand side in FIG. 1

During the screwing down of the sleeve 29, the pins 33 abut the closed ends of the J-slots so that the shear pins 34 are relieved of stress. However, upon subsequently unscrewing the sleeve 29 upwards, to allow radial contraction of the ring 26, for example prior to pulling the tubing string, the shear pins 32 resist the frictional torque between the sleeve 29 and carrier and prevent rotation of the carrier 30 relatively to the hanger 2. If this torque becomes excessive, owing to seizure of the screw threads between the sleeve 29 and carrier 30, the pins 34 will shear, allowing rotation of the carrier 30 on the hanger so that the pins 33 are disengaged from their J-slots and the sleeve 29 can be withdrawn axially with the carrier 30.

I claim:

1. A composite load support ring for use in a wellhead, the composite ring comprising a radially innermost first metallic split ring and a radially outermost second metallic split ring which are interconnected so that axial and radial forces can be transmitted from the first ring to the second ring, the radially Outer surface of the second ring being formed with a plurality of axially spaced annular ribs for engagement, upon radial expansion of the composite ring, with complementary annular grooves in a surrounding tubular wellhead member to fix the composite ring in the wellhead member, and the radially inner surface of the first ring being formed with a frusto-conical taper such that relative axial movement of a complementary frusto-conical surface in engagement with the taper will expand the composite ring radially outwardly.

2. A load support ring according to claim 1, wherein the first and second rings are interconnected by interengaging screw threads on the radially outer surface of the first ring and the radially inner surface of the second ring.

3. A load support ring according to claim 2, in which the first and second rings are keyed together to prevent relative rotation of the rings at the interengaging screw threads.

4. A load support ring according to claim 3, in which the first and second rings are keyed together by a key positioned substantially diametrically opposite to the position at which the first and second rings are split.

5. A load support ring according to claim 4 in which the annular ribs have flanks extending at between 40° and 50° to the axis of the rings.

6. A suspension assembly for suspending a tubing or casing string in a well, the assembly comprising:

a) a wellhead member with annular grooves;

b) a composite load support ring disposed within the wellhead member and including a radially innermost first metallic split ring and a radially outermost second metallic split ring which are interconnected so that axial and radial forces can be transmitted from the first ring to the second ring;

c) the radially outer surface of the second ring being formed with a plurality of axially spaced annular ribs for complimentary engagement, upon radial expansion of the composite ring, with the annular grooves in the wellhead member to fix the composite ring in the wellhead member;

d) the radially inner surface of the first ring being formed with a frusto-conical taper such that relative axial movement of a complimentary frusto-conical surface in engagement with the taper will expand the composite ring radially outwardly; and e) a hanger surrounded by the load support ring, the hanger being formed with the complimentary frusto-conical surface, and with a shoulder to land on the composite load support ring when the load support ring has been fully expanded.

7. An assembly according to claim 6, in which the load support ring is fixed against horizontal displacement on the blocking ring by means of shear elements which are arranged to shear when the load support ring is expanded.

8. An assembly according to claim 7, in which, prior to fixing in the tubular wellhead member, the unexpanded load support ring seats on a blocking ring that is prevented from moving axially on the hanger by the shear elements which, when in use the assembly is lowered into the wellhead member and the blocking ring meets an obstruction, shear to allow the hanger to move down relatively to the blocking ring and load support ring and expand the load support ring.

9. An assembly according to claim 8 in which the hanger carries a surrounding seal assembly for sealing the hanger to the wellhead member, the sealing assembly being set by compression between a shoulder on the hanger and the load support ring during the final downward movement of the hanger relatively to the load support ring.

10. An assembly according to claim 6, in which the second ring is a surrounding metallic split lockdown ring and a lockdown sleeve which is screwed relatively to the hanger and has a radially outer frusto-conical surface complimentary with that of the locking ring whereby the locking ring may be expanded upon screwing of the sleeve along the hanger.

11. An assembly according to claim 10, wherein the lockdown sleeve is screwed onto an annular carrier which is locked axially on the hanger by pins and J-slots, and against rotation relatively to the hanger by the shear elements which, in the event of seizure of screw threads between the lockdown sleeve and the carrier, are arranged to shear to allow rotary and axial movement of the carrier to disengage the pins from their J-slots and hence axial movement of the lockdown sleeve and retraction of the lockdown ring.

12. A wellhead comprising:

a) a suspension assembly for a tubing or casing string, the assembly comprising:

a radially expandable composite load support ring comprising a radially innermost first metallic split ring and a radially outermost second metallic split ring which are interconnected so that axial and radial forces can be transmitted from the first ring to the second ring, the radially outer surface of the second ring being formed with a plurality of axially spaced annular ribs for engagement, upon radial expansion of the composite ring, with complimentary annular grooves in a surrounding tubular wellhead member to fix the composite ring in the wellhead member, and the radially inner surface of the first ring being formed with a frusto-conical taper such that relative axial movement of a complimentary frusto-conical surface in engagement with the taper will expand the composite ring radially outwardly;

a hanger being formed by the complimentary frusto-conical surface and a shoulder to land on the composite load support ring when the load support ring has been fully expanded;

b) a tubular wellhead member having annular grooves to receive the annular ribs of the load support ring, and the radial dimensions of the first and second rings of the load support ring and of the necessary radial expansion of the load support ring to engage the grooves of the wellhead member being such that, when the load support ring is fully expanded, the first and second rings have been deformed within their elastic limit;

c) a blocking ring upon which, prior to fixing in the tubular wellhead member, the unexpanded load support ring seats, the load support ring being fixed against horizontal displacement on the blocking ring by means of shear elements which are arranged to shear when the load support ring is expanded, the blocking ring being further prevented from moving axially on the hanger by shear elements which, when in use, the assembly is lowered into the wellhead member and the blocking ring meets an obstruction, shear to allow the hanger to move down relatively to the blocking ring and load support ring to expand the load support ring;

d) a sealing assembly carried by and surrounding the hanger for sealing the hanger to the wellhead member, the sealing assembly being set by compression between a shoulder on the hanger and the load support ring during a final downward movement of the hanger relatively to the load support ring;

e) a metallic split lockdown ring carried by and surrounding the hanger, the lockdown ring being formed on the radially outer surface of the hanger with a plurality of axially spaced annular ribs for engagement, upon radial expansion of the lockdown ring, with complimentary annular grooves in the wellhead member and, on its radially inner surface with a downwardly and radially inwardly frusto-conical taper;

f) a lockdown sleeve which is carded by and surrounding the hanger and which is screwed relatively to the hanger and having a radially outer frusto-conical surface complimentary with that of the locking ring whereby the locking ring may be expanded upon screwing of the sleeve along the hanger; and g) an annular carrier onto which the lockdown sleeve is screwed, the annular carrier being locked axially on the hanger by pins and J-slots, and against rotation relatively to the hanger by shear elements which, in the event of seizure of screw threads between the lockdown sleeve and the carrier, are arranged to shear to allow rotary and axial movement of the carrier to disengage the pins from their J-slots and hence allow axial movement of the lockdown sleeve and retraction of the lockdown ring.

* * * * *